US010279612B2

(12) United States Patent
Nakagawa

(10) Patent No.: US 10,279,612 B2
(45) Date of Patent: May 7, 2019

(54) PRINTER AND RECORDING MEDIUM

(71) Applicant: Brother Kogyo Kabushiki Kaisha, Nagoya-shi, Aichi-ken (JP)

(72) Inventor: Kazuya Nakagawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 29 days.

(21) Appl. No.: 15/719,863

(22) Filed: Sep. 29, 2017

(65) Prior Publication Data

US 2018/0141356 A1 May 24, 2018

(30) Foreign Application Priority Data

Nov. 21, 2016 (JP) ..... 2016-226098

(51) Int. Cl.

| | |
|---|---|
| ***B41J 2/355*** | (2006.01) |
| ***B41J 29/38*** | (2006.01) |
| ***B41J 2/35*** | (2006.01) |
| ***B41J 3/407*** | (2006.01) |
| ***B41J 15/04*** | (2006.01) |

(52) U.S. Cl.

CPC ..... *B41J 29/38* (2013.01); *B41J 2/35* (2013.01); *B41J 2/355* (2013.01); *B41J 3/4075* (2013.01); *B41J 15/042* (2013.01)

(58) Field of Classification Search

CPC ..... B41J 2/335; B41J 2/33505; B41J 2/3352; B41J 2/34; B41J 2/355; B41J 2/35; B41J 15/042; B41J 3/4075; B41J 29/38

See application file for complete search history.

(56) References Cited

U.S. PATENT DOCUMENTS

| | | | | |
|---|---|---|---|---|
| 6,172,688 | B1 * | 1/2001 | Iwasaki | B41J 3/4075 347/2 |
| 2013/0169728 | A1 * | 7/2013 | Tanizaki | B41J 2/355 347/192 |
| 2016/0001574 | A1 * | 1/2016 | Ishino | B41J 2/3551 347/180 |

FOREIGN PATENT DOCUMENTS

| | | | |
|---|---|---|---|
| JP | H11-334129 | A | 12/1999 |
| JP | 2014-104700 | A | 6/2014 |

* cited by examiner

*Primary Examiner* — Kristal Feggins

(74) *Attorney, Agent, or Firm* — Banner & Witcoff, Ltd.

(57) ABSTRACT

The disclosure discloses a printer including a memory storing computer-executable instructions that cause the printer to further perform a first determination process and a second determination process. In the first determination process, it is determined whether or not a preceding line location reaches an inter-page position between two adjacent pages of a print-receiving medium. In the second determination process, it is determined whether or not the either one state of the first and second energization state is switched to another state of the first state and the second energization state. In the case that it is determined that the either one state is switched to said another state, the print parameters being calculated in the parameter calculation process.

9 Claims, 16 Drawing Sheets

[FIG. 1]
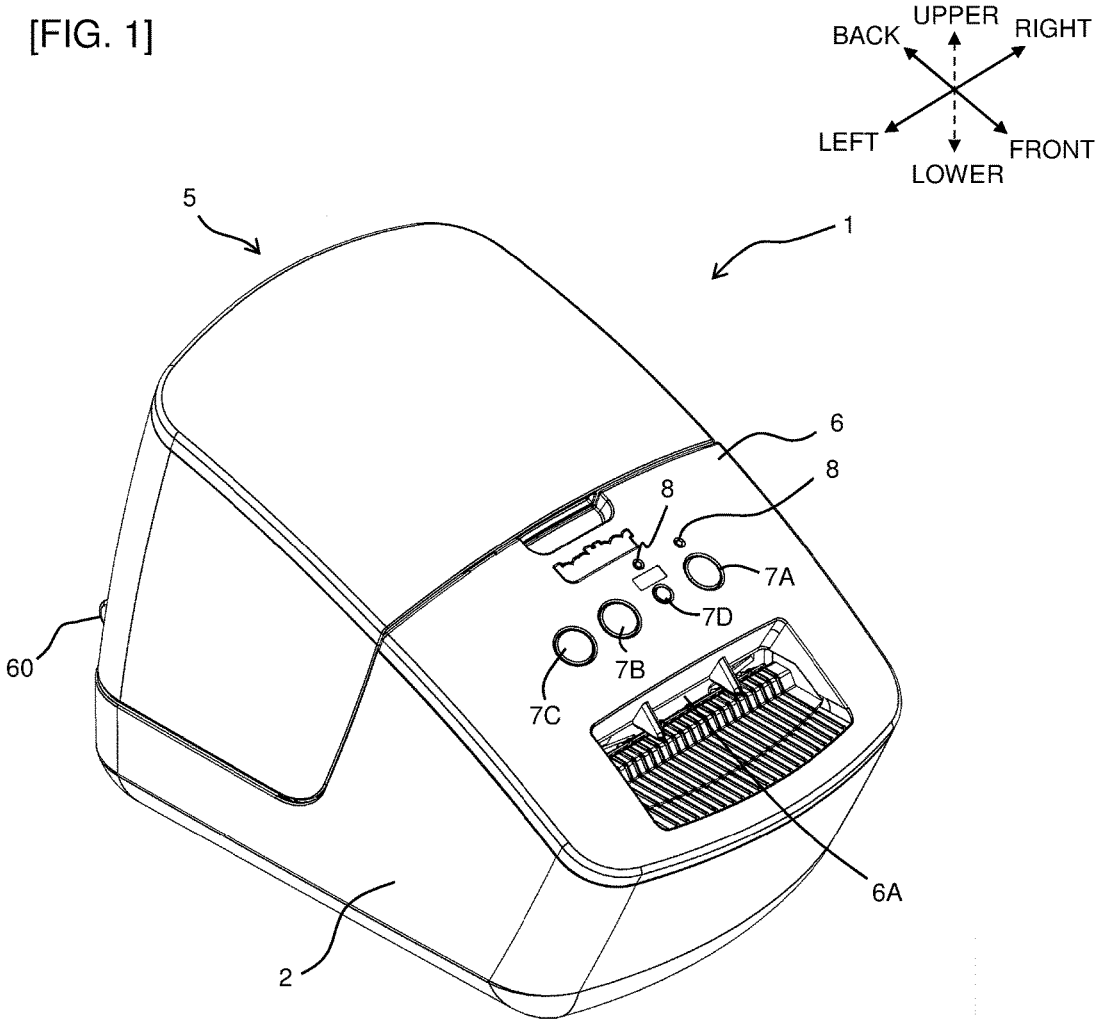

[FIG. 2]
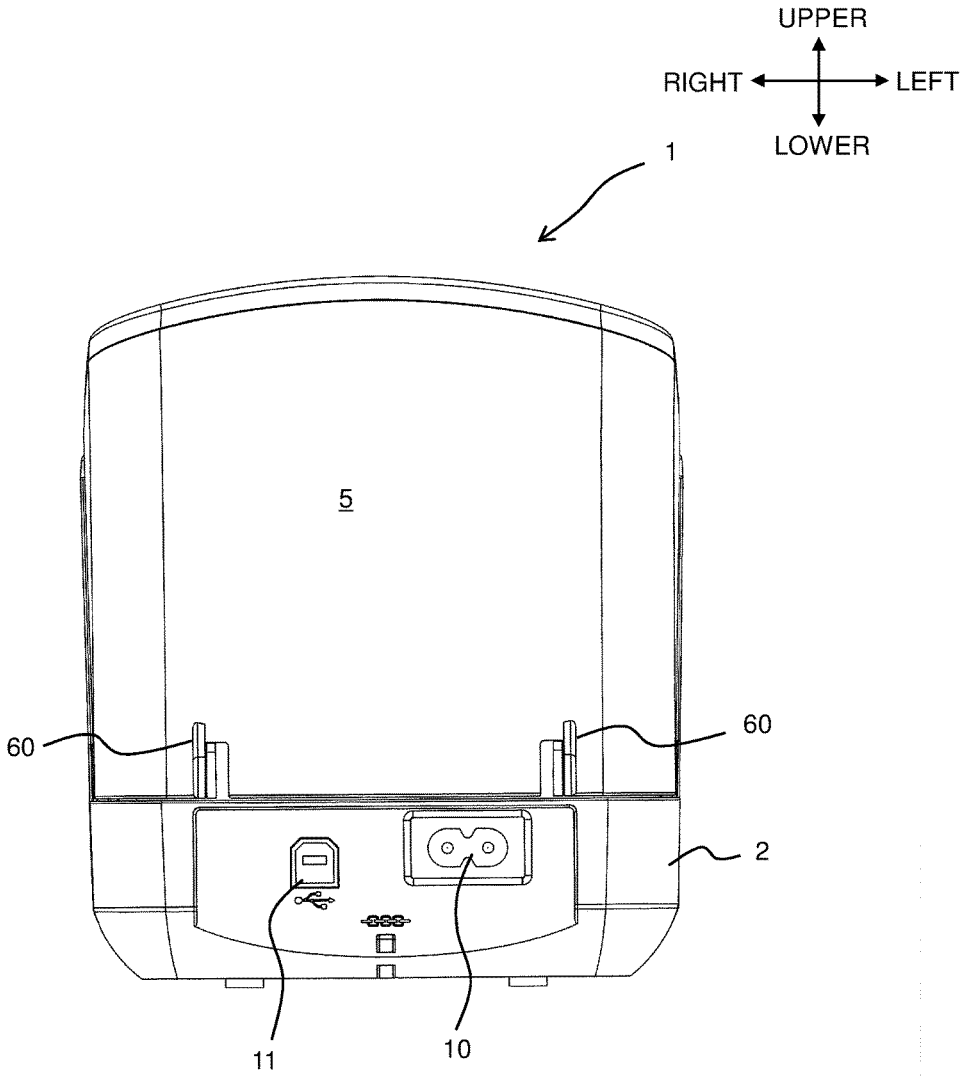

[FIG. 3]
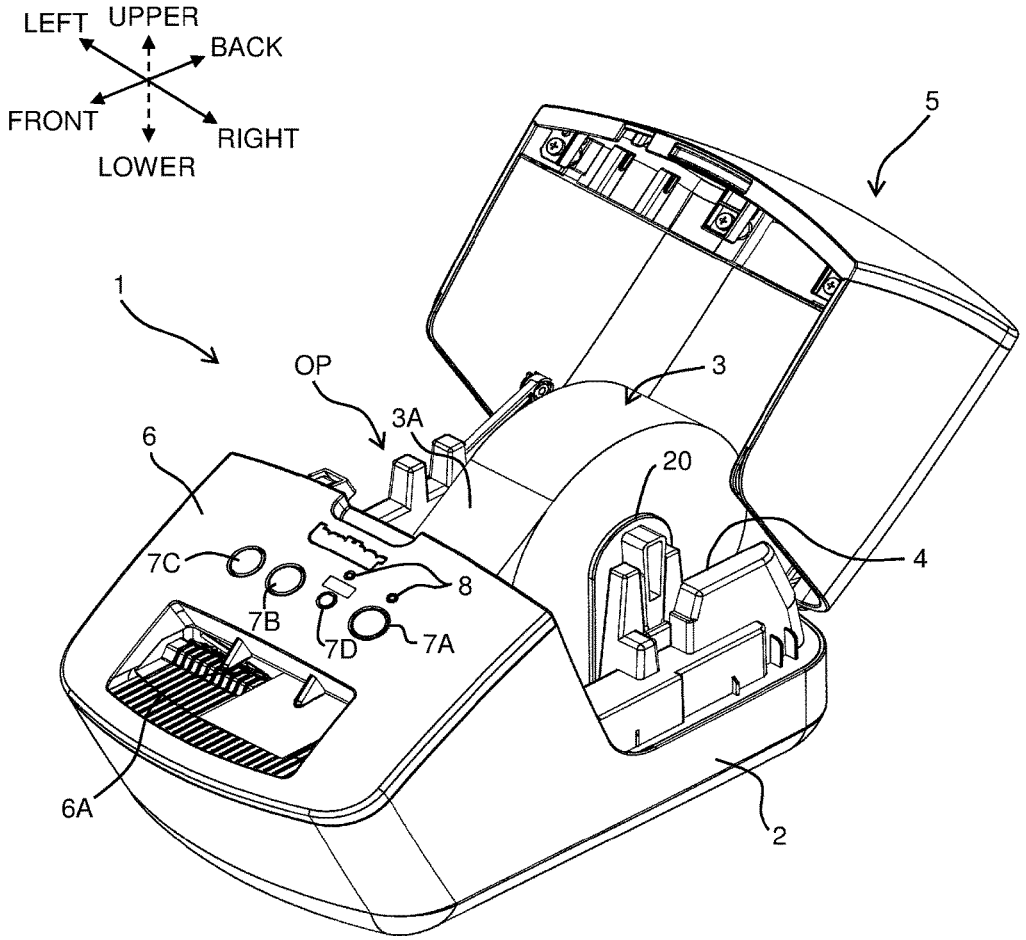

[FIG. 4]
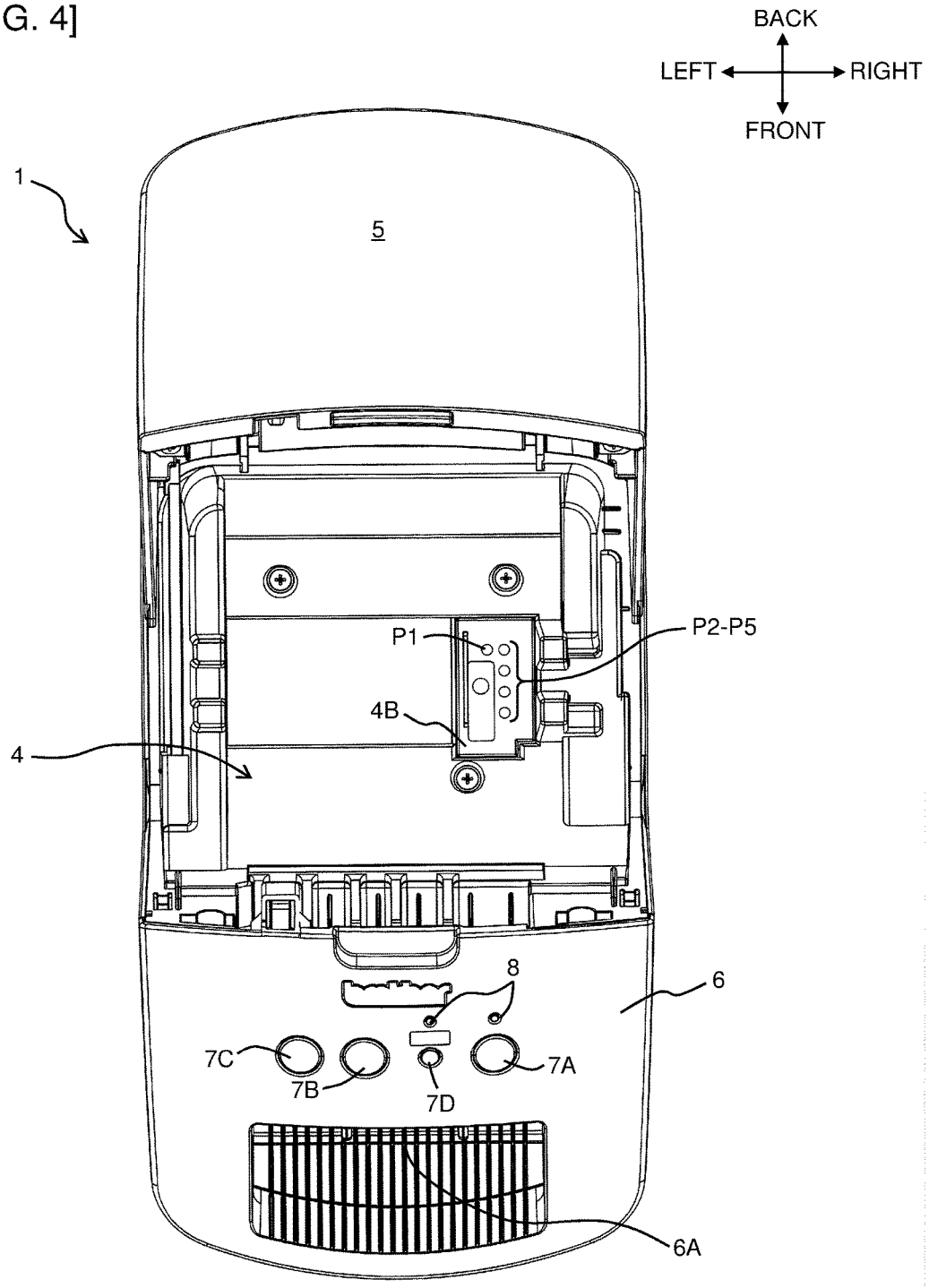

[FIG. 5]
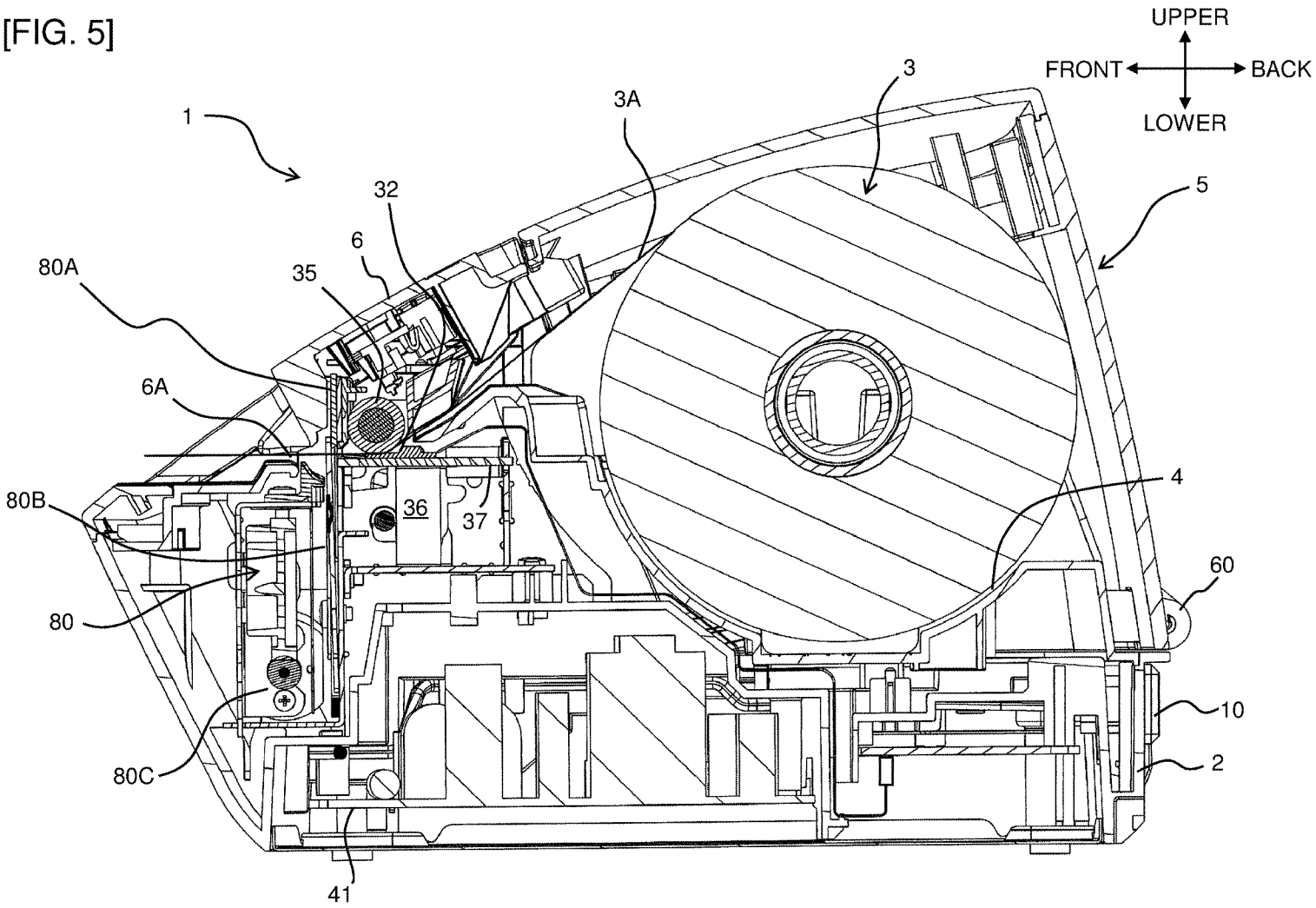

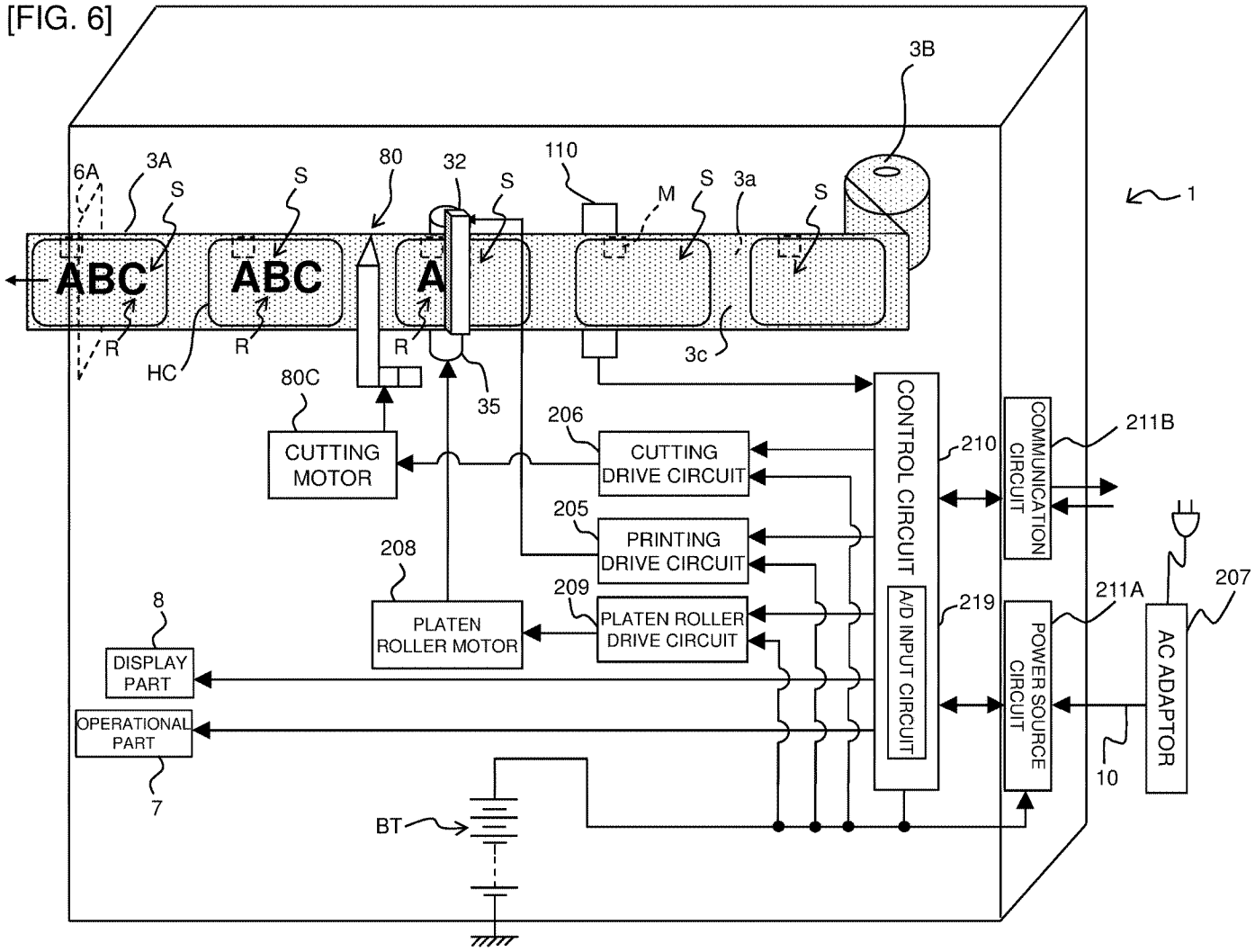
[FIG. 6]

FIRST COMPARATIVE EXAMPLE
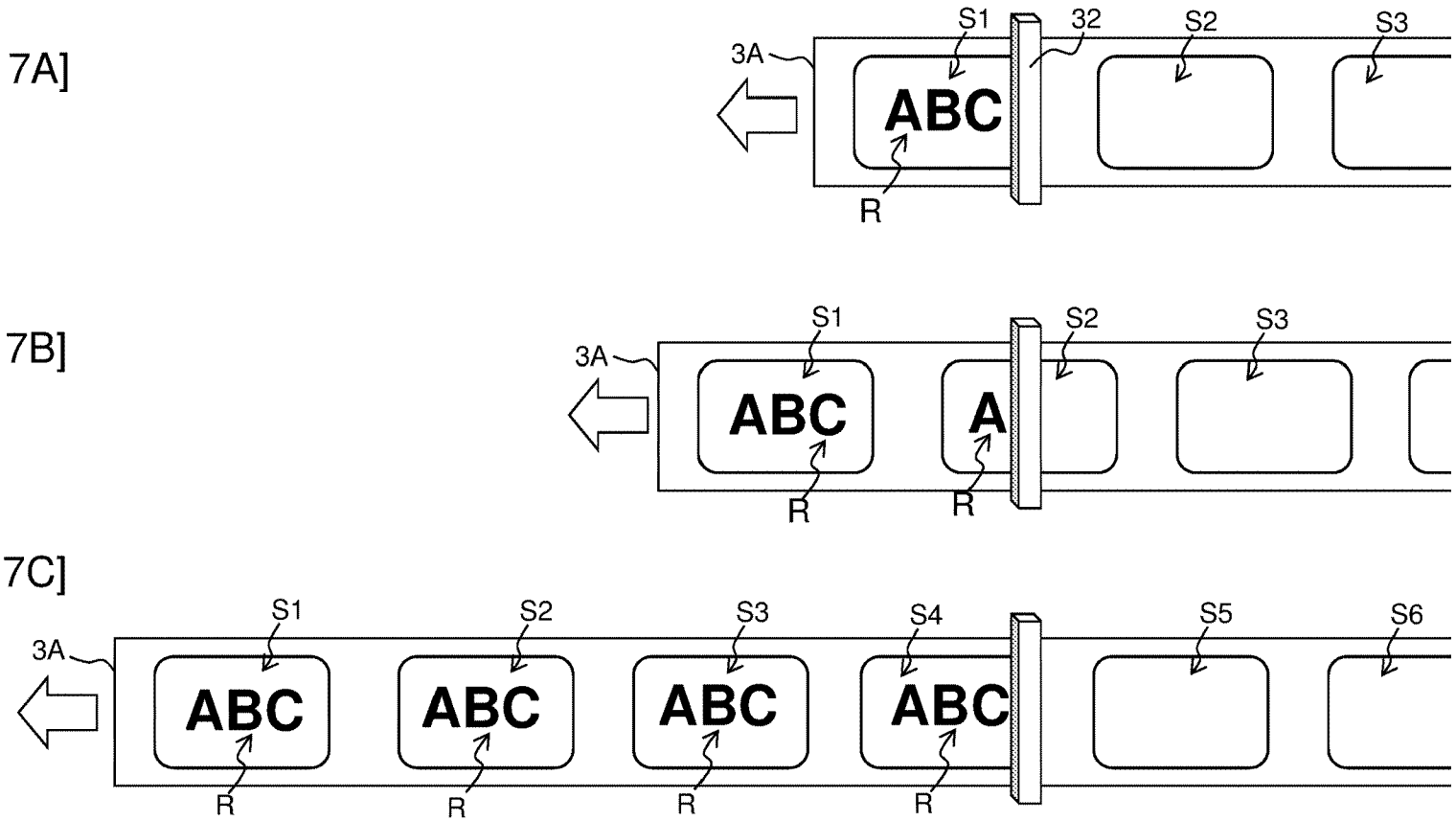
[FIG. 7A]
[FIG. 7B]
[FIG. 7C]

SECOND COMPARATIVE EXAMPLE
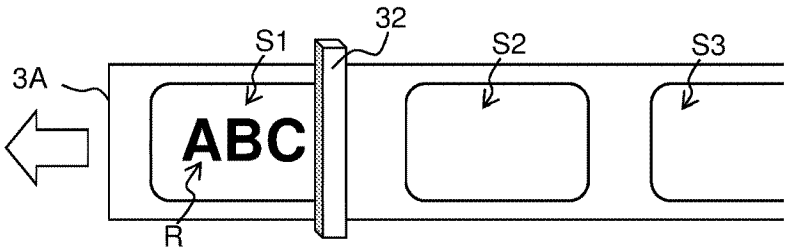
[FIG. 8A]
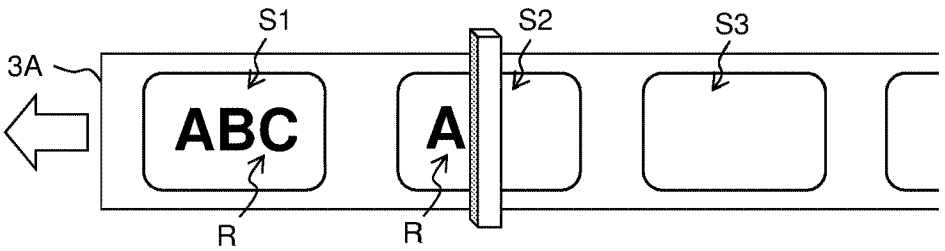
[FIG. 8B]
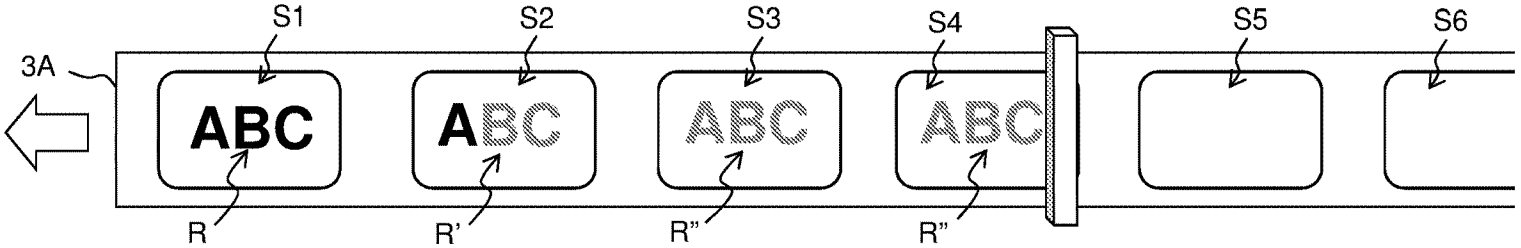
[FIG. 8C]

[FIG. 9]

| | | AC POWER SOURCE (SECOND ENERGIZATION STATE) | BATTERY (FIRST ENERGIZATION STATE) |
|---|---|---|---|
| 150-DOT ON DATA | NUMBER OF ENERGIZATION SESSIONS FOR FORMING ONE LINE | 1 | 2 |
| | ENERGIZATION TIME PERIOD FOR FORMING ONE LINE | Ta | 2 Ta |
| | PRINTING SPEED | Va | 1/2 Va |
| 720-DOT ON DATA | NUMBER OF ENERGIZATION SESSIONS FOR FORMING ONE LINE | 3 | 5 |
| | ENERGIZATION TIME PERIOD FOR FORMING ONE LINE PRINTING SPEED | Tb | 5/3 Tb |
| | ENERGIZATION TIME PERIOD FOR FORMING ONE LINE PRINTING SPEED | Vb | 3/5 Vb |

[FIG. 10]
SECOND COMPARATIVE EXAMPLE
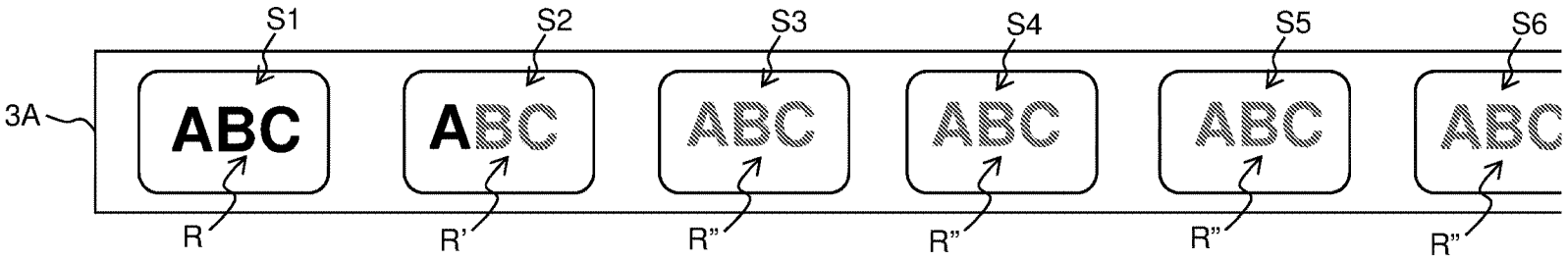

EMBODIMENT
[FIG. 11A]
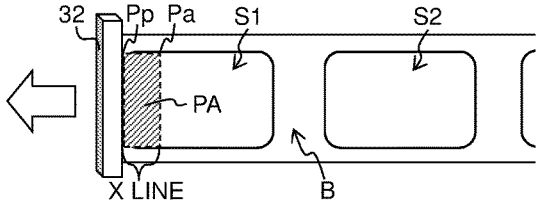
[FIG. 11B]
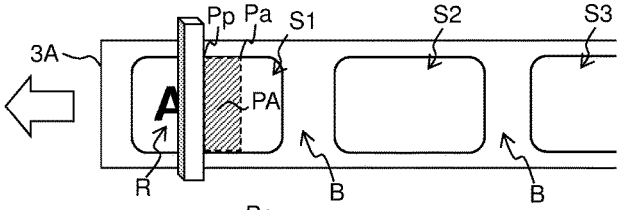
[FIG. 11C]
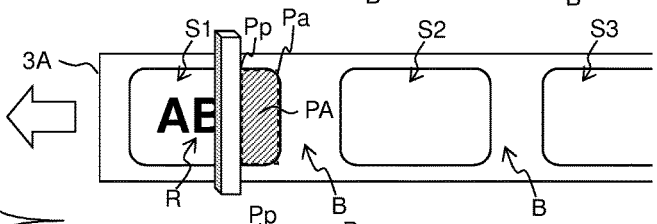
AT THIS TIMING, SWITCHING FROM SECOND ENERGIZATION STATE TO FIRST ENERGIZATION STATE IS DETECTED
[FIG. 11D]
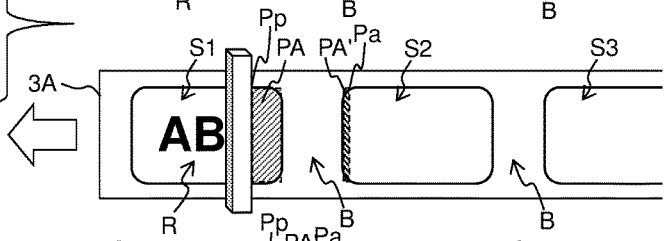
[FIG. 11E]
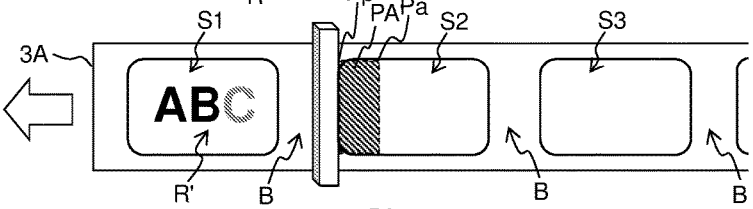
[FIG. 11F]
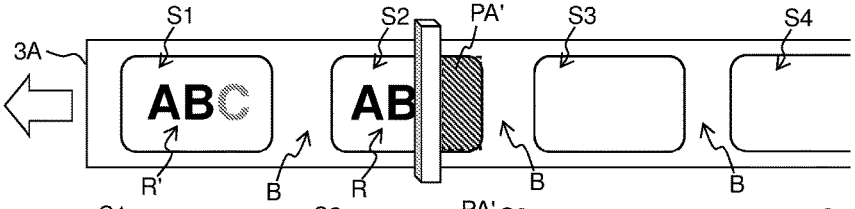
[FIG. 11G]
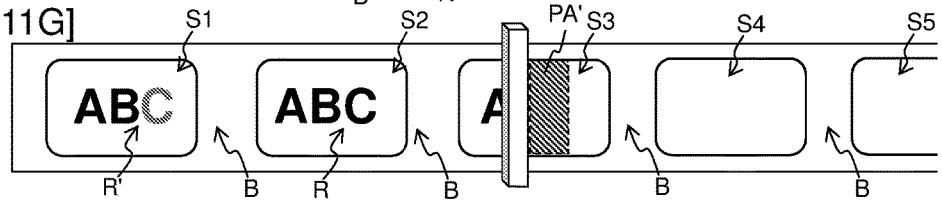

EMBODIMENT
[FIG. 12A]
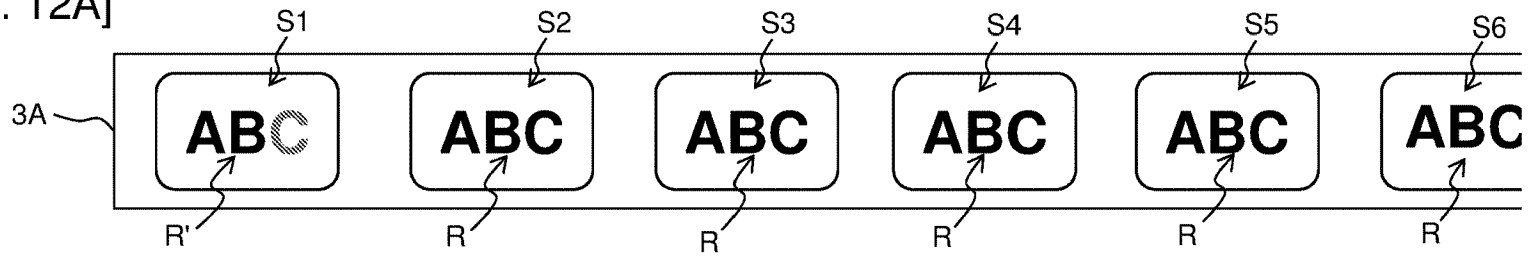
[FIG. 12B]
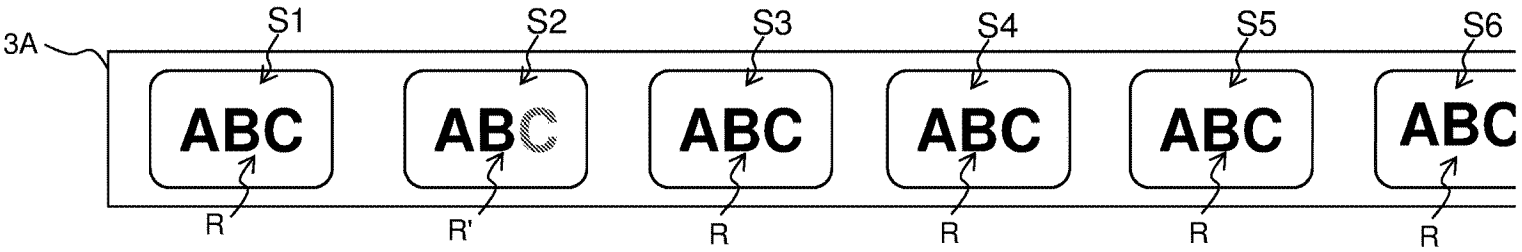

[FIG. 13]
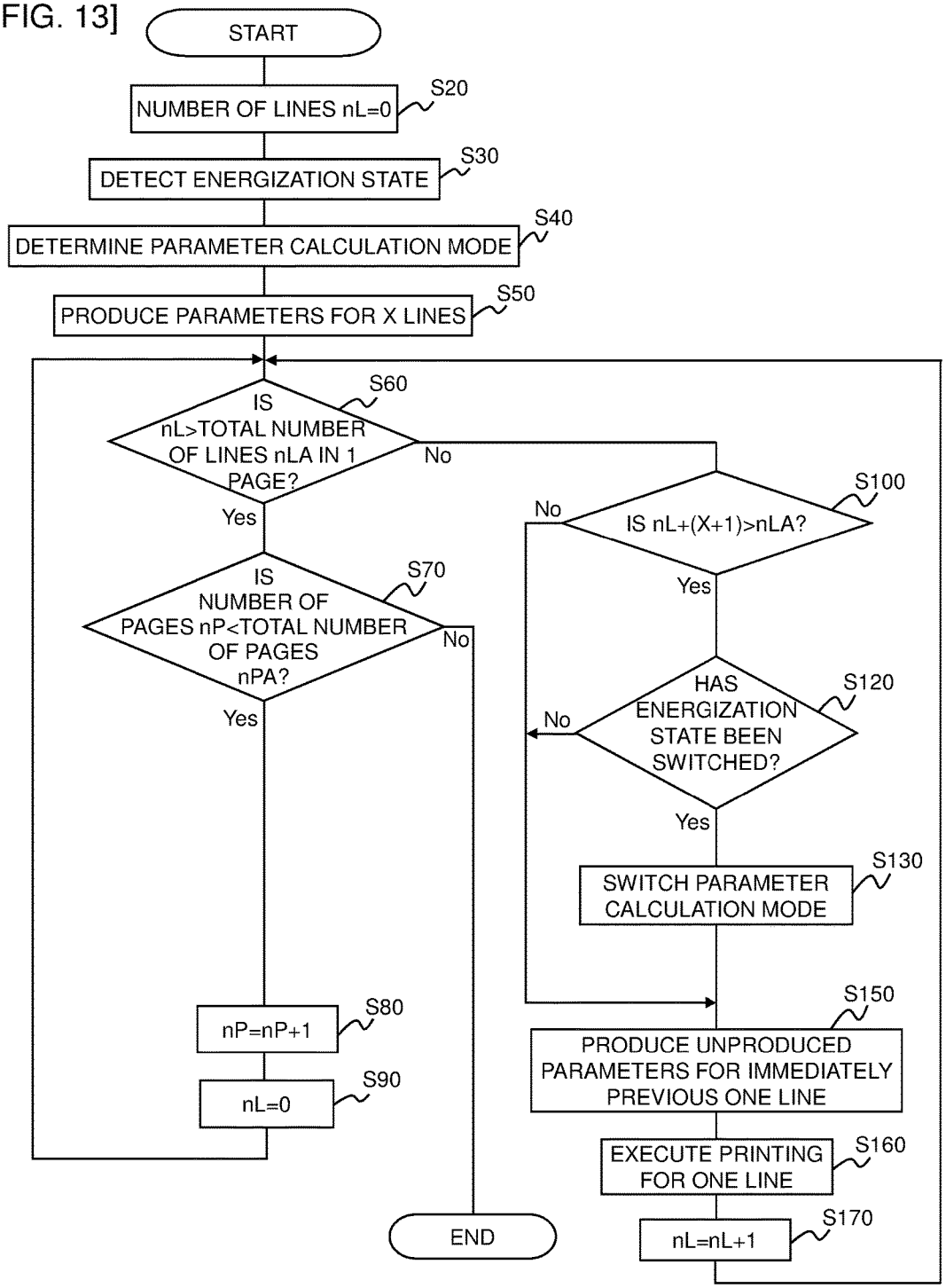

[FIG. 14]
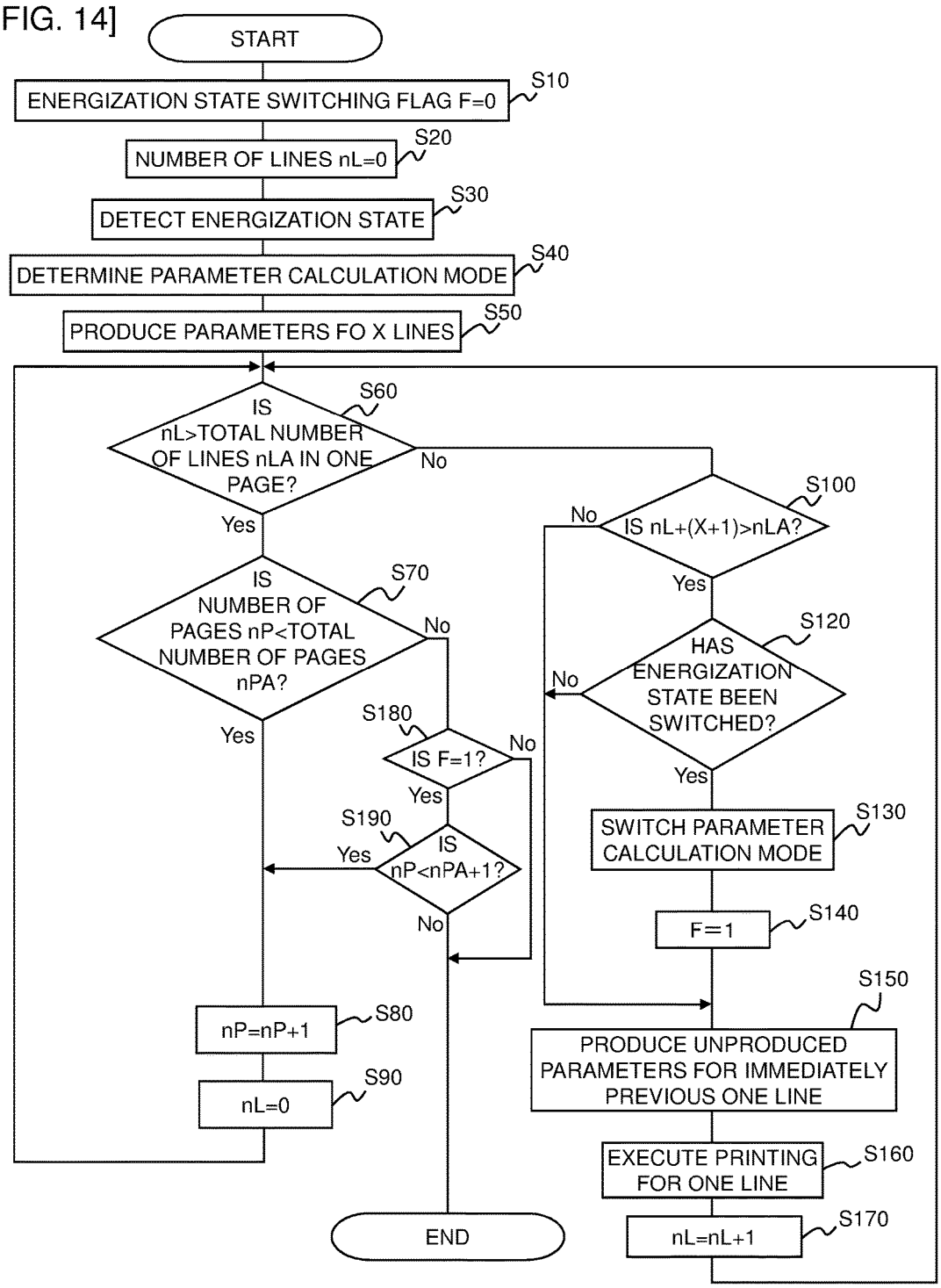

[FIG. 15A]
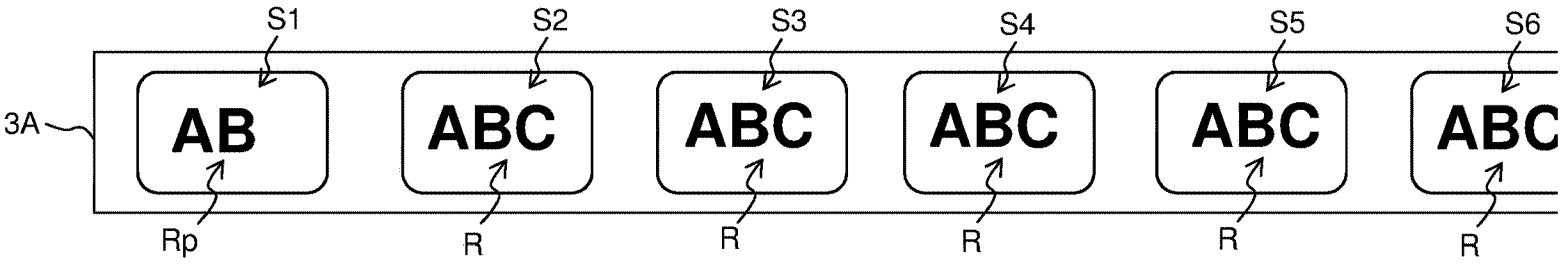
[FIG. 15B]
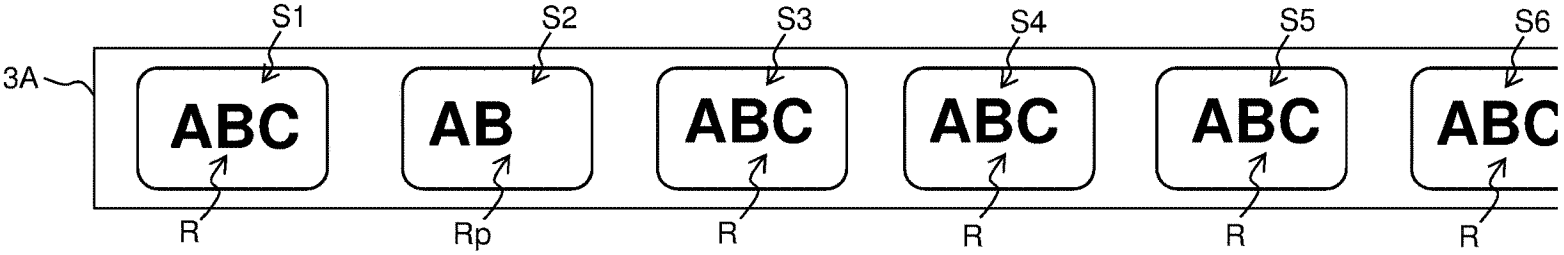

[FIG. 16A]
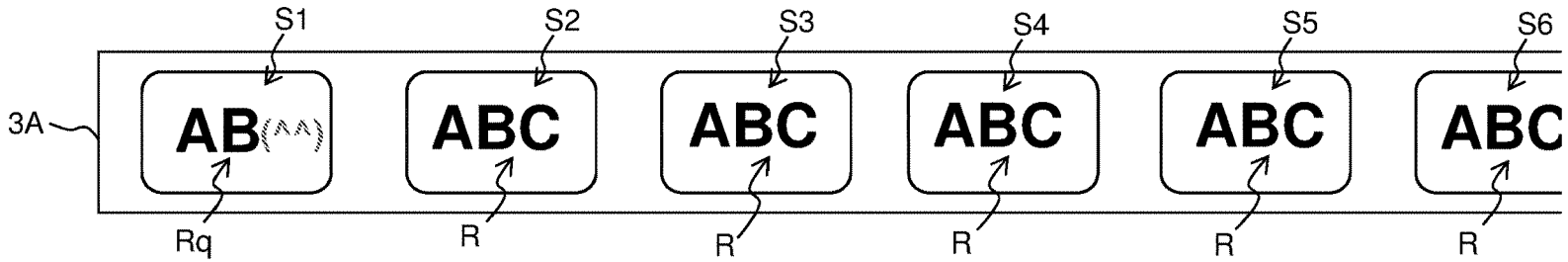
[FIG. 16B]
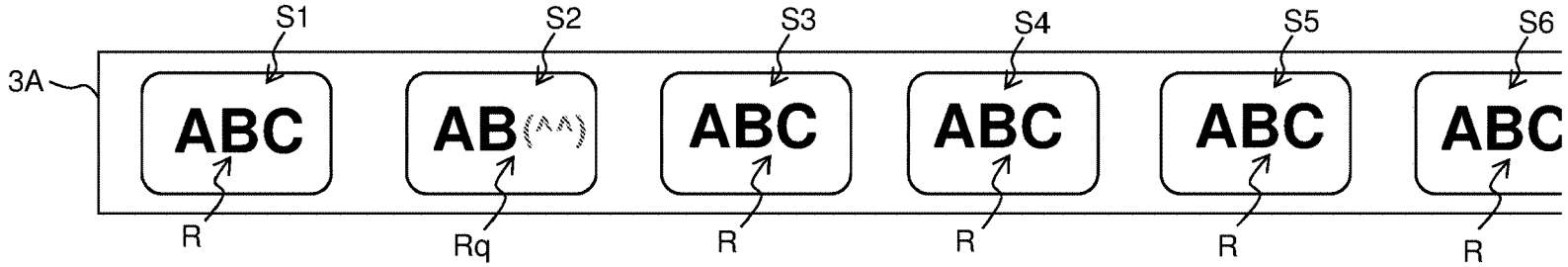

PRINTER AND RECORDING MEDIUM

CROSS-REFERENCE TO RELATED APPLICATION

The present application claims priority from Japanese Patent Application No. 2016-226098, which was filed on Nov. 21, 2016, the disclosure of which is incorporated herein by reference in its entirety.

BACKGROUND

Field

The present disclosure relates to a printer that forms a desired print on a print-receiving medium, and a recording medium.

Description of the Related Art

A printer executing desired printing by forming dots using a printing head thereof in each of plural pages of a fed print-receiving medium (a print-receiving tape) is known. In this case, print parameters (such as, for example, the printing speed and the energization time period for the heat generating elements) used for the dot formation are usually calculated concurrently in parallel to the printing by the printing head. For example, when the printing head forms the dots at a position facing the printing head (a what-is-called print line location) of the print-receiving medium, the print parameters to be applied to the position that precedes the print line location of the print-receiving medium by the predetermined number of lines (a position on an upstream side along a feeding direction) are calculated prior to their use by the printing head.

The prior art printer can operate in both of an energization state on the basis of a battery and an energization state on the basis of an external power source. In this case, for example, during the operation in either one of the energization states, the operation may be switched to the operation in the other energization state for some reason (such as the fact that a plug connecting to the external power source is unplugged by an accident, or that the printer is connected to an external power source during the operation by the battery).

The print parameters significantly differ in their values between those for the energization state on the basis of a battery and those for the energization state on the basis of an external power source. For example, when, using the print parameters in accordance with the energization state before the switching, the printing is also continued as it is after the switching, the print quality may significantly be degraded in all the pages printed after the switching. To avoid this, for example, employment of a technique of once stopping the printing immediately after the switching of the energization state, calculating the print parameters in accordance with the energization state after the switching, and thereafter newly resuming the printing can be considered while, in this case, a stoppage time period is generated and a long time period is necessary for the printing operation for all the pages intended by the operator to come to an end.

SUMMARY

An object of the present disclosure is to provide a printer capable of causing a printing operation to rapidly come to an end suppressing any degradation of the print quality even when the energization state is switched, and a recording medium.

In order to achieve the above-described object, according to the aspect of the present application, there is provided a printer comprising a feeder configured to feed a print-receiving medium that comprises plural pages along a longitudinal direction of the print-receiving medium, a drive device configured to drive the feeder, a printing head that comprises plural heat generating elements arranged in a row along a direction perpendicular to a feeding direction of the feeder, and is configured to sequentially form dots in accordance with a feeding by the feeder on print lines each formed by dividing the print-receiving medium by a print resolution along the feeding direction, a battery storage part configured to store therein a battery, a processor, and a memory, the memory storing computer-executable instructions that, when executed by the processor, cause the printer to perform a parameter calculation process for calculating print parameters for formation of dots by the printing head, in the parameter calculation process, during formation of the dots by the printing head, the print parameters to be applied at a preceding line location being calculated, wherein the preceding line location precedes a print line location at which the dots are currently formed by predetermined number of lines, the printing head being configured to form the dots at the print line location by means of using the print parameters already calculated antecedently in the parameter calculation process, the drive device and the plural heat generating elements being configured to selectively operate in either a first energization state by the battery stored in the battery storage part or a second energization state by an external power source, thereby the printer executing printing for the plural pages without stopping the drive device during the printing, the memory storing computer-executable instructions that, when executed by the processor, cause the printer to further perform a first determination process for, after the print parameters in accordance with either the first energization state or the second energization state are calculated in the parameter calculation process and formation of the dots by the printing head by using the print parameters is started, determining whether or not the preceding line location reaches an inter-page position between two adjacent pages of the print-receiving medium, and a second determination process for, in the case that it is determined in the first determination process that the preceding line location reaches the inter-page position, determining whether or not the either one state of the first energization state and the second energization state is switched to another state of the first energization state and the second energization state, in the case that it is determined in the second determination process that the either one state is switched to the another state, the print parameters in accordance with the another state that the one state is switched being calculated in the parameter calculation process.

BRIEF DESCRIPTION OF THE DRAWINGS

FIG. 1 is a perspective view showing an outer appearance of a print label producing device in relation to an embodiment of the present disclosure.

FIG. 2 is a back view showing the print label producing device.

FIG. 3 is a perspective view showing the state where a roll sheet holder is attached to the print label producing device with an opening and closing cover that is opened.

FIG. 4 is a plan view showing the state where the opening and closing cover of the print label producing device is opened.

FIG. 5 is a side cross-sectional view showing the state where the roll sheet holder is attached to the print label producing device.

FIG. 6 is a functional block view showing a control system of the print label producing device.

FIG. 7A is an explanatory view showing a label production behavior in First Comparative Example where plural print labels are produced in the state where no switching of any energization state is executed.

FIG. 7B is an explanatory view showing a label production behavior in First Comparative Example where the plural print labels are produced in the state where no switching of any energization state is executed.

FIG. 7C is an explanatory view showing the label production behavior in First Comparative Example where the plural print labels are produced in the state where no switching of any energization state is executed.

FIG. 8A is an explanatory view showing a label production behavior in Second Comparative Example where, when switching of the energization state is executed, all the print labels are produced using print parameters before the switching.

FIG. 8B is an explanatory view showing the label production behavior in Second Comparative Example where, when the switching of the energization state is executed, all the print labels are produced using the print parameters before the switching.

FIG. 8C is an explanatory view showing the label production behavior in Second Comparative Example where, when the switching of the energization state is executed, all the print labels are produced using the print parameters before the switching.

FIG. 9 is a table showing an example of the difference in the values of the parameters on the basis of the difference between the energization states.

FIG. 10 is an explanatory view showing an example of an outer appearance of a roll sheet having a print formed thereon by a technique of Second Comparative Example.

FIG. 11A is an explanatory view showing a label production behavior in the technique of an embodiment of the present disclosure.

FIG. 11B is an explanatory view showing the label production behavior in the technique of an embodiment of the present disclosure.

FIG. 11C is an explanatory view showing the label production behavior in the technique of an embodiment of the present disclosure.

FIG. 11D is an explanatory view showing the label production behavior in the technique of an embodiment of the present disclosure.

FIG. 11E is an explanatory view showing the label production behavior in the technique of an embodiment of the present disclosure.

FIG. 11F is an explanatory view showing the label production behavior in the technique of an embodiment of the present disclosure.

FIG. 11G is an explanatory view showing the label production behavior in the technique of an embodiment of the present disclosure.

FIG. 12A is an explanatory view showing an example of the outer appearance of a roll sheet having a print formed thereon by the technique of an embodiment of the present disclosure.

FIG. 12B is an explanatory view showing the example of the outer appearance of the roll sheet having a print formed thereon by the technique of an embodiment of the present disclosure.

FIG. 13 is a flowchart showing control steps executed by a CPU of a control circuit.

FIG. 14 is a flowchart showing control steps executed by the CPU of the control circuit in a modification example where print labels whose number is greater than the user-designated number by one are produced.

FIG. 15A is an explanatory view showing an example of the outer appearance of the roll sheet having a print formed thereon, in a modification example where printing for a page whose print quality may be degraded associated with the switching of the energization state is discontinued.

FIG. 15B is an explanatory view showing an example of the outer appearance of the roll sheet having a print formed thereon, in the modification example where the printing for the page whose print quality may be degraded associated with the switching of the energization state is discontinued.

FIG. 16A is an explanatory view showing an example of the outer appearance of a roll sheet having a print formed thereon, in a modification example where printing for a page whose print quality may be degraded associated with the switching of the energization state is discontinued and another image is formed by printing.

FIG. 16B is an explanatory view showing an example of the outer appearance of the roll sheet having a print formed thereon, in a modification example where the printing for the page whose print quality may be degraded associated with the switching of the energization state is discontinued and another image is formed by printing.

DETAILED DESCRIPTION OF THE PREFERRED EMBODIMENTS

An embodiment of the present disclosure will be described below with reference to the drawings.

In this embodiment, the present disclosure is applied to a print label producing device 1 as a printer. An outlined configuration of the print label producing device 1 in relation to this embodiment will first be described with reference to FIG. 1 to FIG. 4.

<Outlined Structure of Print Label Producing Device>

As shown in FIG. 1, FIG. 2, and FIG. 3, the print label producing device 1 includes a housing 2 that is made from a resin, that constitutes the outer shell of the device 1, and that includes a roll sheet holder storage part 4 storing therein a roll sheet holder 3 having a roll sheet 3A (corresponding to a print-receiving medium) having a predetermined width wound therein, and an opening and closing cover 5 that is made from a transparent resin and that is attached to be able to open and close to an upper end edge portion on the back side through a pair of hinge parts 60 on the right and the left in the back portion side to cover the upper side of the sheet holder storage part 4.

The roll sheet 3A includes a long strip-like sheet or the like that has plural pages in its longitudinal direction, and is wound in the roll sheet holder 3. Especially, in this example, the roll sheet 3A is a what-is-called die cut tape (see FIG. 6 described later) that has plural label mount paper sheets S each separated in advance in a predetermined size and each including a thermal layer 3*c* having a self-color-development property, consecutively arranged being distant from each other in the longitudinal direction on a face on one side of a separation sheet 3*a* (see FIG. 6 described later).

The opening and closing cover 5 is supported by the housing 2 through the hinge parts 60 to be rotatable, and opens or closes an opening OP present above the roll sheet holder storage part 4 by the rotation.

A sheet discharge exit 6A to discharge the printed roll sheet 3A to the exterior is formed on a front cover 6 on the front side of the opening and closing cover 5. In the front face portion on the upper side of the sheet discharge exit 6A, a total of four buttons including a power source button 7A, a cut button 7B whose being pressed down drives a cutter unit 80 (see FIG. 5 described later) disposed on the inner side of the sheet discharge exit 6A to cut off the roll sheet 3A to produce a print label (not shown), a feed button 7C that causes the roll sheet 3A to be discharged in the feeding direction during the time period for the feed button 7C to be pressed down, and another button 7D are substantially horizontally arranged (hereinafter, these will properly be collectively referred to simply as "operational part 7"). A display part 8 including, for example, an LED is arranged in the vicinity of each of the power source button 7A and the control button 7D on the front cover 6.

On the back face portion of the housing 2, an inlet 10 to which a power source cord 11 (see FIG. 6 described later) is connected from an AC adaptor 207 (see FIG. 6 described later) connected to an external power source is arranged and, on the side thereof (see the left side in FIG. 2), a USB connector 11 to which a personal computer (not shown) or the like as an operational terminal is connected is disposed.

<Details of Roll Sheet Holder Storage Part>

As shown in FIG. 3 and FIG. 4, on the bottom face portion of the roll sheet holder storage part 4, a determination recess part 4B having a rectangular shape in a plan view that is longitudinally elongated in the feeding direction is formed. The determination recess part 4B faces a sheet determination part (not shown) that extends in an inner side direction at a substantially right angle from the lower end edge portion of a positioning holding member 20 constituting the roll sheet holder 3.

In the determination recess part 4B, five sheet determination sensors P1, P2, P3, P4, and P5 that each include a push micro-switch and the like, and that are to determine the type, the material quality, the roll sheet width, and the like of the roll sheet 3A are disposed in an L-shape in this example. Each of the sheet determination sensors P1-P5 each include a known mechanical switch including a plunger, a micro-switch, and the like, and the upper end portion of each plunger is disposed to protrude from the bottom face portion of the determination recess part 4B. The sheet determination sensors P1-P5 each detect the presence or the absence of a sensor hole (not shown) formed in the sheet determination part that extends in an inner side direction at a substantially right angle from the lower end edge portion of the positioning holding member 20, for the sensors P1-P5, and detect the type, the material quality, the roll sheet width, and the like of the roll sheet 3A that is attached to the roll sheet holder 3, on the basis of their ON/OFF signals.

<Internal Devices Such as Thermal Head/Cutter Unit>

As shown in FIG. 5, on the deeper side in a roll sheet feeding direction of an insertion entrance 26, a platen roller 35 (corresponding to a feeder) is rotatably journaled. A thermal head 32 (corresponding to a printing head) is fixed on an upper face of a head supporting member 37 urged upward by a pressing spring 36.

The cutter unit 80 is disposed on a downstream side (the left side in FIG. 5) in the feeding direction of the roll sheet 3A from the platen roller 35 and the thermal head 32. As shown in FIG. 5, the cutter unit 80 includes a fixed blade 80A and a movable blade 80B. When the cut button 7B is pressed down, the movable blade 80B is reciprocated in the up-and-down direction by a cutting motor 80C that includes a DC motor and the like. As a result, the roll sheet 3A after the printing therefor is executed by the thermal head 32 is cut off to have a desired length by the fixed blade 80A and the movable blade 80B to be discharged from the sheet discharge exit 6A.

On the other hand, a control substrate 40, a power source substrate 41, a battery storage part (not shown) having a battery BT stored therein described later, and the like are disposed under the roll sheet holder storage part 4. The control substrate 40 has a control circuit 210 (see FIG. 6 described later) arranged thereon to drive and control the mechanism parts such as the thermal head 32 in accordance with instructions from the external computer or the like, and is electrically connected to the sheet determination sensors P1 to P5. The power source substrate 41 has a power source circuit 211A (see FIG. 6 described later) arranged thereon.

<Control System of Label Producing Device>

A control system of the label producing device 1 will be described with reference to FIG. 6.

In FIG. 6, the label producing device 1 includes the platen roller 35 that feeds and sends out the roll sheet 3A to the sheet discharge exit 6A, a platen roller drive circuit 209 that controls a platen roller motor 208 (corresponding to a drive device) driving the platen roller 35, a printing drive circuit 205 that controls energization for the thermal head 32, a cutting drive circuit 206 that controls the cutting motor 80C driving the cutter unit 80, and the control circuit 210 to control the operation of the overall label producing device 1 through the printing drive circuit 205, the platen roller drive circuit 209, the cutting drive circuit 206, and the like.

The control circuit 210 is a what-is-called micro-computer and, though not shown in detail, includes a CPU to be a central processing unit that functions as a processor, a ROM that functions as a memory (a recording medium), a RAM, and the like. The control circuit 210 executes signal processing in accordance with programs (including a printing process program to execute control steps in FIG. 13, FIG. 14 described later) stored in advance in the ROM using the temporary storage function of the RAM. The control circuit 210 is connected to the display part 8, the operational part 7, and a communication circuit 211B. The control circuit 210 is connected to a proper communication line through the communication circuit 211B and, as a result, can transmit and receive information to/from a route server, other terminals, a multi-purpose computer, an information server, and the like all not shown that are connected to the communication line.

The control circuit 210 is also connected to the power source circuit 211 A. The power source circuit 211A is connected to the AC adaptor 207 that is connected to an external power source, and executes ON/OFF processes of the power source of the print label producing device 1. In this case, a control circuit 210 includes an A/D input circuit 219 that is connected to the battery BT (for example, a lithium-ion battery) stored in the battery storage part and that is to measure (detect) the output voltage value of the battery BT. As a result, for the platen roller drive circuit 209, the printing drive circuit 205, and the cutting drive circuit 206, either power supplying by an external power source through the AC adaptor 207 or power supplying by the battery BT can selectively be executed. In this example, in the case where the battery BT is stored in the battery storage part, when the connection to an external power source is established by the power source cord 11 and the AC adaptor 207, the power supplying by the external power source is automatically selected in accordance with a known technique and, when the connection to the external power source is cancelled (such as unplugging of the power source cord 11 or the AC adaptor 207), the power supplying by the battery BT is automatically established in accordance with a known technique.

On the other hand, as shown in FIG. 6, as to the roll sheet 3A wound in the roll sheet holder 3, as above, the side of the thermal layer 3*c* of each of the label mount paper sheets S is a print area in which the print R is formed by the thermal head 32. In this case, on the side of the thermal layer 3*c* of the label mount paper sheet S, a half cut line HC having a substantially rectangular shape to peel off the label mount paper sheet S after its print formation from the separation sheet 3*a* is formed. The desired print R on the basis of print data is printed onto the label mount paper sheet S surrounded by the half cut line HC. After the printing, the label mount paper sheet S is peeled off from the separation sheet 3*a* through the half cut line HC, and the label mount paper sheet S is bonded to an adherend by an adhesive layer on the back face of the label mount paper sheet S.

In this example, plural marks M each corresponding to one of the label mount paper sheets S are formed on the surface (on the side opposite to the side with the thermal layer 3*c*) of the separation sheet 3*a*. The marks M are each detected by an optical sensor 110 and positioning of the label mount paper sheet S for feeding is executed using the result of this detection. In this embodiment, during the printing, in accordance with the control by the CPU of the control circuit 210 through the platen roller drive circuit 209, the platen roller motor 208 executes printing for the label mount paper sheets S in the plural pages without stopping the printing in the course thereof (what-is-called non-stop printing, see FIG. 11 and the like descried later). Instead of the mark M, an edge of the half cut line HC constituting an end face of the label mount paper sheet S may be detected. The roll sheet 3A having the print R formed thereon in this manner is cut off by the cutter unit 80 as a result of the operation of the cutting button 7B as above, and a print label is produced.

<Energization Control for Thermal Head>

The energization control for the thermal head 32 by the printing drive circuit 205 will be described in detail. The thermal head 32 includes plural heat generating elements arranged in the direction perpendicular to the feeding direction. The plural heat generating elements form the print R by forming dots in accordance with the print data on print lines of the roll sheet 3A. For example, the CPU of the control circuit 210 produces the print data to form the dots using the heat generating elements from, for example, character string information acquired by an operation of a user (the operator) through the operational part 7. The CPU produces the print data (image data including pieces of data each for a dot as a unit) to be printed, based on a character string input into the CPU and a dot pattern stored in advance in a CG-ROM (not shown) or the like in the ROM, and the CPU divides the print data into pieces each for one line as a unit to be printed by the heat generating elements arranged in a row in the thermal head 32. For example, when the printing resolution is set to be 360 dpi, line print data for lines each formed by dividing into 360 lines per inch is produced. The printing drive circuit 205 supplies a drive signal to the thermal head 32 on the basis of the line print data from the CPU to control the driving form of the thermal head 32. The printing drive circuit 205 writes the line print data into data registers that are each correlated with one of the heat generating elements and thereafter controls the time period and the cycle of the energization for each of the heat generating elements based on a strobe signal. As a result, the printing control circuit 205 controls the heat generation form of the overall thermal head 32.

The process of the dot formation on each of the print lines of the roll sheet 3A by the energization for the thermal head 32 will be described in detail. The "print line" refers to a line having a row of dots formed therein in the width direction of the roll sheet 3A by executing the energization for the heat generating elements in the row for one printing cycle, and is present at an interval acquired by dividing the unit length of the roll sheet 3A in the feeding direction by the resolution. The "one printing cycle" refers to a time period necessary for forming the dots in one row in the width direction of the roll sheet 3A. The length of the one printing cycle varies in accordance with the resolution, and the feeding speed of a tape 103 and the like. For example, one printing cycle for the printing at 360 dpi and 40 mm/s is the time period necessary for passing between the print lines at 360 dpi (for example, about 0.07 mm) at 40 mm/s (for example, about 1.8 ms).

For forming the dots in one row in the width direction of the roll sheet 3A, the line print data for one print line produced by the CPU is transferred to the thermal head 32 and the pertinent heat generating elements are energized on the basis of the transferred lint print data for the one print line. The "line print data for one print line" refers to the print data to form dots for one row in the width direction of the roll sheet 3A as a result of the energization for the heat generating elements in the row for one printing cycle. As a result, the heat generating elements energized on the basis of the line print data for the one print line generate heat for the temperature to reach the color development temperature that is necessary for the thermal layer 3*c* to develop a color. As a result, the point in contact with the thermal head 32 of the thermal layer 3*c* develops the color by the heating by the heat generating elements and the dots for the one print line are formed on the roll sheet 3A. The process for developing the color by the heating is repeatedly executed for each one print line feeding the roll sheet 3A at a predetermined feeding speed determined in advance. Every time this is executed, the many heat generating elements arranged in the thermal head 32 are selectively and intermittently energized on the basis of the print data for the print lines transferred from the CPU. As a result, a dot image (such as text characters) that is in accordance with the above operation by the user through the operational part 7 and that is desired by the user is formed as the print R on the roll sheet 3A.

In accordance with the fact that the roll sheet 3A is fed and the print lines of the roll sheet 3A sequentially pass by the position of the heat generating elements as above, the energization form of the heat generating elements is sequentially switched for each piece of the line print data. As a result, the thermal head 32 can execute the printing at the printing cycle (in other words, the printing speed) matched with the feeding speed of the roll sheet 3A.

When the printing of the dot pattern data comes to an end, the feeding of the roll sheet 3A is stopped and the cutting motor 80C is driven through the cutting drive circuit 206 and, as a result, cutting of the roll sheet 3A is executed by the cutter unit 80 to produce a print label.

<Print Parameters>

In the label producing device 1 of this embodiment, dots are formed by the heat generating elements of the thermal head 32 on each of the print lines and, as a result, the printing of a desired image is executed. The print parameters (such as, for example, the printing speed and the energization time period for the heat generating elements) used for forming the dots are calculated by the CPU of the control circuit 210.

As above, the print label producing device 1 can operate in both of the energization state on the basis of the battery BT stored in the battery storage part (the first energization state) and the energization state on the basis of an external power source through the AC adaptor 207 (the second energization state). In this case, the energization state may be switched because of the fact, for example, that, during the operation in the second energization state, a plug connecting the AC adaptor 207 to an external power source or the power source cord 11 is unplugged by an accident or, on the contrary, that, during the operation in the first energization state where the power source cord 11 is unplugged from the inlet 10, the user intentionally inserts the power source cord 11 into the inlet 10 to connect to the external power source, or the like. The print parameters significantly differ in their values between those for the first energization state on the basis of the battery BA and those for the second energization state on the basis of the external power source. As a result, for example, when, using the print parameters in accordance with the energization state before the switching, the printing is also continued as it is after the switching, the print quality may significantly be degraded in all the pages printed after the switching. Examples of this case will be described with reference to FIG. 7 and FIG. 8.

FIG. 7A-FIG. 7C show the case where same print objects (in this example, the print R of a text "ABC") are consecutively formed on the plural label mount paper sheets S of the roll sheet 3A in still the second energization state on the basis of the external power source (without any switching of the energization state), as First Comparative Example. In this case, on the roll sheet 3A fed leftward as shown (see white arrows), the print R of "ABC" is formed for the first (that is, the first page, and the same will hereinafter be applied) label mount paper sheet S1 as shown in FIG. 7A by the thermal head 32. As shown in FIG. 7B and FIG. 7C, the same prints R of "ABC" is thereafter formed for each of the second (the second page) label mount paper sheet S2, the third (the third page) label mount paper sheet S3, the fourth (the fourth page) label mount paper sheet S4, and so on.

FIG. 8 show the case where the switching of the energization state occurs as above in the course of the execution of the printing for the consecutive plural pages as above, as Second Comparative Example. In this case, similarly to FIG. 7A, in the second energization state on the basis of the external power source, the feeding of the roll sheet 3A toward the left side as shown is started and the print R of "ABC" is formed on the first (the first page) label mount paper sheet S1 shown in FIG. 8A by the thermal head 32. It is assumed that, for example, the plug of the AC adaptor 207 or the power source cord 11 is thereafter unplugged in the course of the formation of the print R of "ABC" on the second (the second page) label mount paper sheet S1 (at the timing at which the formation of the print of "A" comes to an end) as shown in FIG. 8B and the energization state is switched to the first energization state (that is, the power supplying from the battery BA). In this case, because the print parameters significantly differ in their values between those for the first energization state and those for the second energization state as above, when, still using the print parameters in accordance with the second energization state, the formation of the print R is also continued in the first energization state after the switching, the print quality may significantly be degraded.

<One Example of Difference in Print Parameters>

An example of the difference in the print parameters between the first energization state and the second energization state will be described with reference to FIG. 9. In this example, examples of the number of energization sessions, the energization time period, and the printing speed of the heat generating elements of the thermal head 32 as the print parameters will be described.

For example, in the label producing device 1 of this embodiment, the dot width of the thermal head 32 is set to be 720 dots. With the energization control of the thermal head 32, in the second energization state on the basis of the external power source, the maximal on-dot number capable of being concurrently energized is 240 dots (that is, ⅓ of the overall width of the thermal head 32) and, in the first energization state on the basis of the battery BT, the maximal on-dot number capable of being concurrently energized is 144 dots (that is, ⅕ of the overall width of the thermal head 32).

As shown in the columns in the upper half of FIG. 9, for example, when the print is formed using data that turns on 150 dots, the number of energization session is one that is sufficient in the second energization state (whose maximal on-dot number is 240 dots) and, in contrast, the energization needs to be divided into two sessions (=the number of energization sessions of two) in the first energization state (whose maximal on-dot number is 144 dots). The energization time period necessary for forming one print line of this data needs, representing that of the case for the second energization state as "Ta", to be a two-fold time period thereof, that is, a time period of 2×Ta in the first energization state. As a result, the printing speed needs, representing that of the case for the second energization state as "Va", to be reduced to be a half thereof in the first energization state, that is, Va/2.

Similarly, as shown in the columns in the lower half of FIG. 9, for example, when the print is formed using data that turns on 720 dots, the number of energization sessions is three that is sufficient in the second energization state (whose maximal on-dot number is 240 dots) and, in contrast, five energization sessions need to be executed in the first energization state (whose maximal on-dot number is 144 dots). The energization time period necessary for forming one print line of this data needs, representing that of the case for the second energization state as "Tb", to be a 5/3-fold time period thereof, that is, a time period of 5/3×Tb in the first energization state. As a result, the printing speed needs, representing that of the case for the second energization state as "Vb", to be reduced to be a 3/5-fold value thereof, that is, (3/5)×Vb in the first energization state.

When the formation of the print R is continued still using the print parameters in accordance with the second energization state (also in the first energization state after the switching) as above despite the fact that the print parameters differ between the first energization state and the second energization state, as shown in, for example, FIG. 8C, degradation of the print quality (such as, for example, blurring and insufficient color development in this example, and the same will hereinafter be applied) occurs in "BC" after the switching, of a print R' of "ABC" on the second (the second page) label mount paper sheet S2. As also shown in FIG. 10, the same degradation of the print quality occurs in all the prints R each of "ABC" on the succeeding the third (the third page) label mount paper sheet S3, the fourth (the fourth page) label mount paper sheet S4, the fifth (the fifth page) label mount paper sheet S5, the sixth (the sixth page) label mount paper sheet S6, and so on.

To avoid the above, employment of a technique of once stopping the formation operation of the print R immediately after the switching of the energization state (the second energization state to the first energization state), calculating the print parameters in accordance with the energization state after the switching (=the first energization state), and thereafter newly resuming the formation of the print R can be considered while, in this case, a stoppage time period is generated and a long time period is necessary for the printing operation of all the pages intended by the user to come to an end.

A technique of this embodiment to avoid the above will be described with reference to FIG. 11 and FIG. 12. In FIG. 11, in this embodiment, the calculation of the print parameters is concurrently executed by the CPU in parallel to the print formation by the thermal head 32. For example, when the thermal head 32 forms dots at a print line location Pp that faces the thermal head 32 of the roll sheet 3A, the CPU calculates the print parameters (prior to the use thereof by the thermal head 32) that are applied to a preceding line location Pa preceding (=to be on the upstream side along the feeding direction) the print line location Pp by predetermined number of lines (X lines shown in FIG. 11A; "X" is a proper positive integer determined in advance).

At the time when the printing is started shown in FIG. 11A (the state where the print formation is not yet started), the CPU already produces the print parameters for the X lines that precede the print line location Pp. In other words, the print formation by the thermal head 32 is started after the print parameters for the preceding X lines are produced.

From the state in FIG. 11A, the print formation is started using the print parameters that are already produced to form dots for each one line at the print line location Pp and, associated with this, the CPU newly produces the print parameters such that the X lines preceding the print line location Pp always are an area PA having parameters already produced therefor (the area from the print line location Pp to the preceding line location Pa) (see FIG. 11B).

FIG. 11C shows the state where the print formation of "AB" of "ABC" by the thermal head 32 comes to an end as above. At this timing, as shown, the location of an end on the upstream side in the feeding direction (the right end as shown) of the area PA having parameters already produced therefor reaches an end on the upstream side in the feeding direction (the right end as shown) of the first (the first page) label mount paper sheet S1. At this time, as above, the roll sheet 3A has the plural label mount paper sheets S arranged thereon being distant from each other and an inter-page position B is present between two adjacent label mount paper sheets S, S. The inter-page position B is an area to have no print formation executed therefor (naturally, no calculation of the print parameters is executed therefor). At a timing immediately after the state in FIG. 11C, as shown in FIG. 11D, the thermal head 32 continuously executes the print formation of "C" of "ABC" for the label mount paper sheet S1 while an end on the upstream side in the feeding direction of the area having parameters already produced therefor (for example, an area PA' having parameters already produced therefor, described later) (the right end as shown and, in other words, the preceding line location Pa) enters the second (the second page) label mount paper sheet S2 and reaches the vicinity of an end on the downstream side in the feeding direction (the left end as shown) of the label mount paper sheet S2.

In this embodiment, at the timing at which the state transitions from the state in FIG. 11C to the state in FIG. 11D, that is, the timing at which the preceding line location Pa reaches the inter-page position B, it is determined (detected) whether any switching of the energization state as above (in the above example, the switching from the second energization state to the first energization state) already occurs.

When it is determined that the switching already occurs, the calculation of the print parameters is thereafter newly executed in the form in accordance with the energization state after the switching (in the above example, the first energization state). In the example shown in FIG. 11, the switching from the second energization state to the first energization state occurs in the state shown in FIG. 11C, and this example is described taking an example of the case where this is detected at the timing at which the state transitions from the state shown in FIG. 11C to the state shown in FIG. 11D. As a result of this detection, the area PA' having parameters already produced therefor on the basis of the print parameters after the switching that is different from the area PA having parameters already produced therefor on the basis of the print parameter before the switching used so far is thereafter used (see FIG. 11D).

FIG. 11E shows the state where the feeding and the print formation are further advanced from the state in FIG. 11D. In this state, as shown, the print formation of "ABC" on the first (the first page) label mount paper sheet S1 comes to an end and the print formation of "ABC" on the second (the second page) label mount paper sheet S2 is about to be started. As above, the switching from the second energization state to the first energization state occurs in the state where the print formation of "AB" of "ABC" is completed as shown in FIG. 11C while, as shown in FIG. 11C, the print parameters for the print formation of "C" are already produced (in the form in accordance with the second energization state) at this timing (see the area PA having parameters already produced therefor in FIG. 11C and FIG. 11D). As shown in FIG. 11E, for "C" formed on the first label mount paper sheet S1, the same degradation of the print quality as that of Second Comparative Example occurs (see the print R' of "ABC" in FIGS. 11E-11G).

The switching of the energization state is however detected at the timing at which the state transitions from the state in FIG. 11C to the state in FIG. 11D as above and the print parameters are thereafter produced in the form in accordance with the first energization state after the switching (see the area PA' having parameters already produced therefor in FIG. 11D, FIG. 11E). As a result, as shown in FIG. 11F, FIG. 11G, the print R of "ABC" can thereafter be formed with excellent quality (without any degradation of the quality) for each of the second label mount paper sheet S2, the third label mount paper sheet S3, the fourth label paper sheet S4, and so on.

FIG. 12A shows the roll sheet 3A having the print formation executed therefor using the technique of this embodiment as above. As above, as a result of the occurrence of the switching from the second energization state to the first energization state at the timing at which the state transitions from the state in FIG. 11C to the state in FIG. 11D (in other words, the timing at which the print formation of "AB" on the first label mount paper sheet S1 comes to an end), the print R of "ABC" whose "C" has degraded print quality is generated only on the first label mount paper sheet S1 while the print R of "ABC" can be formed with excellent quality on all the label mount paper sheets S other than this, that is, the second label mount paper sheet S2, the third label mount paper sheet S3, the fourth label paper sheet S4, the fifth label mount paper sheet S5, the sixth label mount paper sheet S6, and so on.

FIG. 12B shows the case where the switching of the energization state occurs at another timing. This example is the case where the switching from the second energization state to the first energization state occurs immediately after the state in FIG. 11F (in other words, the timing at which the print formation of "AB" on the second label mount paper sheet S2 comes to an end). In this case, the print R of "ABC" whose "C" has degraded print quality is generated only on the second label mount paper sheet S2 due to the switching while the print R of "ABC" can be formed with excellent quality on all the label mount paper sheets S other than this, that is, the first label mount paper sheet S1, the third label mount paper sheet S3, the fourth label paper sheet S4, the fifth label mount paper sheet S5, the sixth label mount paper sheet S6, and so on.

<Control Steps>

To realize the above technique, control steps executed by the CPU of the control circuit 210 on the basis of the printing process program will be described with reference to FIG. 13.

In a flow shown in FIG. 13, the user issues a printing start instruction through a proper operation on, for example, the operational part 7, another terminal, a multi-purpose computer, or the like and, as a result, this flow is started. At step S20, the CPU initializes a variable nL that represents the number of lines to be printed by the thermal head 32 (corresponding to the print line location Pp), to "0".

At step S30, the CPU detects the energization state (the first energization state on the basis of the battery BT stored in the battery storage part, or the second energization state on the basis of an external power source through the AC adaptor 207) using a known technique. The control step thereafter moves to step S40.

At step S40, the CPU determines the calculation mode for the print parameters in accordance with the energization state detected at step S30. When the first energization state is detected at step S30, the CPU determines the mode (the battery power source mode) in accordance with the power supplying from the battery BT and, when the second energization state is detected at step S30, the CPU determines the mode (the AC power source mode) in accordance with the power supplying from the external power source through the AC adaptor 207.

At step S50, the CPU thereafter produces the pertinent print parameters for X lines in accordance with the calculation mode determined at step S40.

For example, when the CPU determines the calculation mode to be the AC power source mode at step S40, in accordance with the above example, for the data that turns on 150 dots, the print parameters are produced (set) to be one as the number of energization session, Ta as the energization time period per one print line, and Va as the printing speed. For example, for the data that turns on 720 dots, the print parameters are produced (set) to be three as the number of energization sessions, Tb as the energization time period per one print line, and Vb as the printing speed. On the other hand, when the CPU determines the calculation mode to be the battery power source mode at step S40, for the data that turns on 150 dots, the print parameters are produced (set) to be two as the number of energization sessions, 2×Ta as the energization time period per one print line, and Va/2 as the printing speed. For the data that turns on 720 dots, the print parameters are produced (set) to be five as the number of energization sessions, 5/3×Tb as the energization time period per one print line, and (3/5)×Vb as the printing speed. The control step thereafter moves to step S60.

At step S60, the CPU determines whether the number of lines nL at this time point is greater than the total number of lines nLA in one page determined in advance (in other words, whether the printing process up to the final line of a page comes to an end at the current time point) or not. During the time period for the number of lines nL to be smaller than the total number of lines nLA, the determination at step S60 is not satisfied (S60: NO) and the control step moves to step S100.

At step S100, the CPU determines whether a value at this time point acquired by adding X+1 to the number of lines nL to be printed by the thermal head 32 (corresponding to the preceding line location Pa) becomes greater than nLA, that is, whether the preceding line location Pa passes over the final line of a page. When the CPU determines that nL+(X+1)≤nLA, the determination is not satisfied (S100: NO) and the control step moves to step S150 described later. When the CPU determines that nL+(X+1)>nLA, the determination is satisfied (S100: YES) and the control step moves to step S120.

At step S120, the CPU determines whether the energization state at this time point is switched from the energization state detected at step S30 (from the first energization state to the second energization state, or from the second energization state to the first energization state), using a known technique. When the CPU determines that the energization state is not especially switched, the determination is not satisfied (S120: NO) and the control step moves to step S150 described later. When the CPU determines that the energization state is switched, the determination is satisfied (S120: YES) and the control step moves to step S130.

At step S130, the CPU switches the calculation mode for the print parameters determined at step S40 to a mode different therefrom. When the CPU determines the calculation mode to be the AC power source mode at step S40, the CPU switches the calculation mode to the battery power source mode and, when the CPU determines the calculation mode to be the battery power source mode at step S40, the CPU switches the calculation mode to the AC power source mod. The control step moves to step S150.

At step S150, the CPU produces (calculates) the print parameters for the one line at the head of those whose print parameters are not yet produced at this time point, in accordance with the parameter calculation mode set at this time point (determined at step S40 or step S130). The control step thereafter moves to step S160.

At step S160, the CPU executes the printing process for one line. The CPU outputs a control signal to the platen roller drive circuit 209 to cause the platen roller motor 208 to drive the platen roller 35 to feed the roll sheet 3A by one line, and outputs the pertinent control signal to the printing drive circuit 205 to drive the heat generating elements of the thermal head 32 to execute print formation for the one line for the roll sheet 3A. At step S170, the CPU thereafter increments the number of lines nL to nL+1 and the control step returns to step S60 to repeat the same steps. As a result, during the time period for the print line location Pp to be present in the same page (during the time period for the determination at step S60 to be not satisfied), the flow of step S60 to step S100-step S130 to step S150 to step S160 to step S170 and so on is repeated and, as a result, the print formation (the printing process) is executed one line by one line. When these control steps are repeated, every time the preceding line location Pa preceding the print line location Pp reaches the inter-page position B, the determination at step S100 is satisfied and a check on the switching of the energization state is properly executed at step S120. When the energization state is switched, the mode for the calculation of the print parameters is switched (step S130) and the calculation is thereafter executed in the mode after the switching (step S150).

When the printing up to the final line of the page is completed during the repetition of step S60 to step S100-step S130 to step S150 to step S160 to step S170 to step S60 and so on, the number of lines nL becomes greater than the total number of lines nLA (that is, a thermal head 32 is in the state where the thermal head 32 faces the inter-page position B between the portion at which the printing for a page comes an end and the position at which the printing for the next page starts). As a result, the determination at step S60 is satisfied (S60: YES) and the control step moves to step S70.

At step S70, the CPU determines whether the number of pages nP whose processing is completed by this time point is smaller than the total number of pages nPA that is determined in advance and for which the printing process is to be executed (in other words, whether the printing for all the pages does not yet come to an end). During the time period for nP and nPA to be nP<nPA, the determination at step S70 is satisfied (S70: YES) and the control step moves to step S80.

At step S80, the CPU increments the variable nP that represents the number of pages at this time point to nP+1 and the control step moves to step S90.

At step S90, the CPU initializes the number of lines nL to "0". The control step returns to step S60 and the same steps are thereafter repeated. As a result, the flow of step S60 to step S100-step S130 to step S150 to step S160 to step S170 to step S60 and so on is again repeated to execute the print formation (the printing process) on the basis of the print data. Every time the print formation for the number of all lines of each page comes to an end, the determination at step S60 is satisfied and the flow of step S60 to step S70 to step S80 to step S90 to step S60 and so on is concurrently executed. When the printing for all the pages comes to an end and the number of pages nP becomes greater than the total number of pages nPA, the determination at step S70 is not satisfied (S70: NO) and the flow is caused to come to an end.

In the above flow, step S40 and step S130 correspond to a parameter calculation process described in the appended claims. Step S100 corresponds to a first determination process and step S120 corresponds to a second determination process.

As above, according to this embodiment, when the printing is executed at the print line location Pp, it is determined whether the preceding line location Pa (that temporally precedes) reaches the inter-page position B (see step S100). When it is determined that the preceding line location Pa reaches the inter-page position B (that is, when the thermal head 32 forms dots in a middle portion of a page while the calculation of the print parameters for this page antecedently already comes to an end), it is determined whether the energization state is switched (see step S120). When it is determined that the energization state is switched, the calculation of the print parameters in accordance with the energization state before the switching is caused to come to an end and the calculation of the print parameters is thereafter (that is, from the next page) executed in a form in accordance with the energization state after the switching (see step S130).

As a result, for the next page and those thereafter, for all the pages thereof, the printing is executed using the adequate print parameters that are matched with the energization state, and the portion that may have degraded print quality is limited to a portion of the page for which the dots are currently formed when the above switching is detected (see the first label mount paper sheet S1 in FIG. 11G and FIG. 12A, the second label mount paper sheet S2 in FIG. 12B).

In this embodiment, especially, the determination of the switching is executed when the preceding line location Pa reaches the inter-page position B that has no label mount paper sheet S arranged thereat in the roll sheet 3A that is a what-is-called die cut tape (see step S120). When it is determined that the switching is executed, the calculation of the print parameters in accordance with the energization state after the switching is started (see step S130).

In this embodiment, especially, the thermal head 32 prints the same print object (in the above example, the text of "ABC") in each of the plural pages of the roll sheet 3A.

The present disclosure is not limited to the embodiment and various modifications can be made thereto within a scope not departing from the gist and the technical idea thereof. Such modification examples will sequentially be described below.

(1) Case where More Labels by One are Printed

In this modification example, more print labels by one than the number of print labels to be produced (the total number of pages nPA at step S60) that is accepted in advance by the user are produced.

Control steps executed by the CPU of the control circuit 210 in this modification example will be described with reference to FIG. 14 that corresponds to FIG. 13. The components equivalent to those of the embodiment will be given the same reference numerals and will not again be described or will simply be described.

In this modification example, before a flow shown in FIG. 14 is started, the number of the print labels to be produced is input in advance by the user through a proper operation on the operational part 7, another terminal, a multi-purpose computer, or the like and is accepted by the CPU. This function corresponds to a setting acceptance process described in the appended claims.

In the flow shown in FIG. 14, in addition to the steps in FIG. 13, step S10 and step S140 are newly provided, and step S180 and step S190 are newly provided before the end of the flow for the case where the determination at step S70 is not satisfied.

In FIG. 14, at step S10, the CPU first initializes an energization state switching flag F that indicates the switching of the energization state, to "0".

The control step thereafter moves to step S100 through step S20-step S60 and the determination at step S60 is not satisfied. When the determination at each of step S100 and step S120 is satisfied, the control step moves to step S140 that is newly provided, through step S130. At step S140, the CPU sets the energization state switching flag F to be F=1 indicating that the switching is already executed, in accordance with the fact that the calculation mode for the print parameters is switched at step S130. The control step thereafter moves to step S150 already described.

In the case where the flow of step S60 to step S100-step S140 to step S150 to step S160 to step S170 to step S60 and so on is thereafter repeated as above to execute the print formation one line by one line and, every time the print formation for the number of all lines of each of the pages comes to an end, the flow of step S60 to step S70 to step S80 to step S90 to step S60 and so on is concurrently executed, when the printing for all the pages comes to an end and the number of pages nP becomes greater than the total number of pages nPA, the determination at step S70 is not satisfied (S70: NO) and the control step moves to step S180 that is newly provided.

At step S180, the CPU determines whether the energization state switching flag F is set to be F=1 that indicates that the energization state is already switched. When the CPU determines that the flag F is still F=0 at this time point, the determination at step S180 is not satisfied (step S180: NO) and the CPU causes this flow to come to an end. When the energization state switching flag F is F=1 indicating that the energization state is already switched at step S140, the determination at step S180 is satisfied (S180: YES) and the control step moves to step S190 that is newly provided.

At step S190, the CPU determines whether the number of pages nP for which the processing is completed by this time point is smaller than nPA+1 acquired by adding 1 to the total number of pages nPA for which the printing process is to be executed (in other words, whether the printing up to the total pages+further one page comes to an end). When the CPU determines that nP and nPA+1 are nP<nPA+1, the determination at step S190 is satisfied (S190: YES) and the control step moves to step S80 and the same steps are repeated. Step S180 and step S190 correspond to a first printing control process described in the appended claims. As a result, even assuming that the printing for all the pages for which the printing process is to be executed, that is designated by the user comes to an end, the production of the same print labels Lis executed until all the pages and the extra one page are printed. When the CPU determines that nP and nPA+1 are nP>nPA+1, the determination at step S190 is not satisfied (S190: NO) and the CPU causes this flow to come to an end.

The modification example configured as above has the following technical meaning. As described in the embodiment, for the page having dots currently formed therein at the time of the detection of the switching of the energization state, the print quality may partially be degraded (see the first label mount paper sheet S1 in FIG. 11G and FIG. 12A, and the second label mount paper sheet S2 in FIG. 12B). In this modification example, the printing is executed for the number of pages that is greater by one than the number of pages set by the user.

(2) Case where No Further Print is Formed for Page Used at Time of Switching of Energization State As shown in FIG. 15A and FIG. 15B respectively corresponding to FIG. 12A and FIG. 12B in the embodiment, for the page whose print quality may be degraded by the switching of the energization state (see the first label mount paper sheet S1 in FIG. 11G and FIG. 12A, and the second label mount paper sheet S2 in FIG. 12B), the CPU controls the platen roller motor 208 and the thermal head 32 in cooperation with each other through the platen roller drive circuit 209 and the printing drive circuit 205 and, as a result, the print formation of "ABC" at the timing of the switching and thereafter may be discontinued (see the first label mount paper sheet S1 in FIG. 15A and the second label mount paper sheet S2 in FIG. 15B). In this example, when "AB" is formed by printing, the print formation of "C" to be executed thereafter is discontinued.

In this case, the print formation is resumed using the print parameters in accordance with the energization state after the switching, from the next page succeeding the page (see the second label mount paper sheet S2 in FIG. 15A and the third label mount paper sheet S3 in FIG. 15B). The control in relation to this discontinuation/resuming corresponds to a second printing control process described in the appended claims.

This modification example of the above technique has the following technical meaning. For the page having dots currently formed therein at the time of the detection of the switching of the energization state, the print quality may partially be degraded. When the printing for plural pages is completed, the user may overlook the page having the degraded print quality and may also mistakenly use the page as it is. In this modification example, on the basis of the control by the CPU, for the page for which the printing is executed at the time of the detection of the switching of the energization state (see the first label mount paper sheet S1 in FIG. 15A, the second label mount paper sheet S2 in FIG. 15B), the printing is thereafter discontinued.

(3) Case where Another Image is Formed by Printing Instead of Discontinuation of Printing As shown in FIG. 16A and FIG. 16B respectively corresponding to FIG. 15A and FIG. 15B of the modification example (2), the print formation of "ABC" (corresponding to a first image) at the timing of the switching and thereafter may be discontinued and another image for announcement may thereafter be formed by printing. In this example, the CPU controls the platen roller motor 208 and the thermal head 32 in cooperation with each other through the platen roller drive circuit 209 and the printing drive circuit 205 and, as a result, at the timing at which the uncompleted "AB" is formed by printing, formation of "C" by printing to be executed thereafter is discontinued and an image of "(^^)" (a second image) is formed by printing instead of "C". As a whole, a print label having a print object of "AB(^^)" formed thereon is established.

Similarly to modification example (2), from the next page succeeding the page (see the second label mount paper sheet S2 in FIG. 16A, the third label mount paper sheet S3 in FIG. 16B), the print formation is resumed using the print parameters in accordance with the energization state after the switching. This control corresponds to a third printing control process described in the appended claims.

This modification example of the above technique has the following technical meaning. Similarly to the modification example (2), for the page having dots currently formed therein at the time of the detection of the switching of the energization state, the print quality may partially be degraded. When the printing for the plural pages is completed, the user may overlook the page having the degraded print quality and may also mistakenly use the page as it is. In this modification example, on the basis of the control by the CPU, for the page having an image ("ABC" as above as the print object originally intended to be printed) currently printed therein at the time of the detection of the switching of the energization state, the printing of the image at this time and thereafter is discontinued. The image for announcement ("(^^)" as above) different from the image "ABC" is newly printed in the remaining portion of the page.

(4) Others

The above has been described taking the example of the case where the present disclosure is applied to the print label producing device that produces print labels by executing desired printing using the thermal head 32 for the roll sheet 3A, as a printer while the printer is not limited to this. The present disclosure may be applied to, for example, a printer that forms an image and that prints characters, using a thermal head on an ordinary print-receiving paper sheet (the print-receiving medium) having a size of A4, A3, B4, B5, or the like, as an example of the printer.

In the above, arrows shown in FIG. 6 indicate an example of the flows of the signals and do not limit the flow directions of the signals.

The flowcharts shown in FIG. 13, FIG. 14 each do not limit the present disclosure to the steps shown in these flows, and any addition/deletion to/from, any change of order, or the like of the steps may be made within the scope not departing from the gist and the technical idea of the present disclosure.

In addition to the above, the techniques in accordance with the embodiment and the modification examples may be used properly in combination.

In addition, though not specifically exemplified, the present disclosure is implemented with various changes made thereto within the scope not departing from the gist thereof.

What is claimed is:

1. A printer comprising:

a feeder configured to feed a print-receiving medium that comprises plural pages along a longitudinal direction of the print-receiving medium;

a drive device configured to drive said feeder;

a printing head that comprises plural heat generating elements arranged in a row along a direction perpendicular to a feeding direction of said feeder, and is configured to sequentially form dots in accordance with a feeding by said feeder on print lines each formed by dividing said print-receiving medium by a print resolution along said feeding direction;

a battery storage part configured to store therein a battery;

a processor; and a memory, said memory storing computer-executable instructions that, when executed by said processor, cause said printer to perform a parameter calculation process for calculating print parameters for formation of dots by said printing head, in said parameter calculation process, during formation of said dots by said printing head, said print parameters to be applied at a preceding line location being calculated, wherein said preceding line location precedes a print line location at which said dots are currently formed by predetermined number of lines, said printing head being configured to form said dots at said print line location by means of using said print parameters already calculated antecedently in said parameter calculation process, said drive device and said plural heat generating elements being configured to selectively operate in either a first energization state by the battery stored in said battery storage part or a second energization state by an external power source, thereby said printer executing printing for said plural pages without stopping said drive device during said printing, said memory storing computer-executable instructions that, when executed by said processor, cause said printer to further perform:

a first determination process for, after said print parameters in accordance with either said first energization state or said second energization state are calculated in said parameter calculation process and formation of said dots by said printing head by using said print parameters is started, determining whether or not said preceding line location reaches an inter-page position between two adjacent pages of said print-receiving medium; and a second determination process for, in the case that it is determined in said first determination process that said preceding line location reaches said inter-page position, determining whether or not said either one state of said first energization state and said second energization state is switched to another state of said first energization state and said second energization state, in the case that it is determined in said second determination process that the either one state is switched to said another state, said print parameters in accordance with said another state that the one state is switched being calculated in said parameter calculation process.

2. The printer according to claim 1, wherein in said first determination process, it is determined whether said printing head forms dots in a middle portion of a desired page of said print-receiving medium and calculation of said print parameters of the page comes to an end in said parameter calculation process or not.

3. The printer according to claim 1, wherein said print-receiving medium is a die cut tape that plural label mount paper sheets each separated in advance into a predetermined size are discretely arranged distant from each other on a face on one side of a separation sheet along the longitudinal direction, and wherein in said first determination process, it is determined whether or not said preceding line location reaches said inter-page position that said label mount paper sheet is not arranged and any dot is not formed, between said two adjacent label mount paper sheets of said die cut tape.

4. The printer according to claim 1, wherein said printing head is configured to print a same print object in each of said plural pages.

5. The printer according to claim 4, wherein said memory stores computer-executable instructions that, when executed by said processor, cause said printer to further perform:

a setting acceptance process for accepting a setting for number of pages that print is executed; and a first printing control process for, in the case that it is determined in said second determination process that said either one state is switched to said another state, controlling said drive device and said printing head in cooperation with each other to execute printing for pages for number greater by one than number of pages accepted in said setting acceptance process.

6. The printer according to claim 4, wherein said memory stores computer-executable instructions that, when executed by said processor, cause said printer to further perform a second printing control process for, in the case that it is determined in said second determination process that said either one state is switched to said another state, controlling said drive device and said printing head in cooperation with each other to discontinue printing thereafter on a first page by said printing head wherein printing is executed on the first page at a time point of said determination, and to resume printing by said printing head from a second page next to said first page.

7. The printer according to claim 4, wherein said memory stores computer-executable instructions that, when executed by said processor, cause said printer to further perform a third printing control process for, in the case that it is determined in said second determination process that said either one state is switched to said another state, controlling said drive device and said printing head in cooperation with each other to execute printing thereafter a second image for announcement on a first page that a printing of a first image is executed at a time point of said determination, the second image being different from said first image.

8. The printer according to claim 1, wherein in said parameter calculation process, at least one of a speed of printing on said print-receiving medium by said printing head and an energization time period for said heat generating element is calculated as said print parameters.

9. A non-transitory computer-readable recording medium storing a printing process program to be readable for a computing device, for executing steps on said computing device, said computing device provided to a printer comprising a feeder configured to feed a print-receiving medium that comprises plural pages along a longitudinal direction of the print-receiving medium; a drive device configured to drive said feeder; a printing head that comprises plural heat generating elements arranged in a row along a direction perpendicular to a feeding direction of said feeder, and is configured to sequentially form dots in accordance with a feeding by said feeder on print lines each formed by dividing said print-receiving medium by a print resolution along said feeding direction; a battery storage part configured to store therein a battery; said printer being configured to perform a parameter calculation step for calculating print parameters during formation of said dots by said printing head, wherein said print parameters are to be applied at a preceding line location that precedes a print line location at which said dots are currently formed by predetermined number of lines, said printing head being configured to form said dots at said print line location by means of using said print parameters already calculated antecedently in said parameter calculation step, said drive device and said plural heat generating elements being configured to selectively operate in either a first energization state by the battery stored in said battery storage part or a second energization state by an external power source, thereby said printer executing printing for said plural pages without stopping said drive device during said printing, said steps comprising:

said parameter calculation step;

a first determination step for, after said print parameters in accordance with either said first energization state or said second energization state are calculated in said parameter calculation step and formation of said dots by said printing head by using said print parameters is started; determining whether or not said preceding line location reaches an inter-page position between two adjacent pages of said print-receiving medium and a second determination step for, in the case that it is determined in said first determination step that said preceding line location reaches said inter-page position, determining whether or not said either one state of said first energization state and said second energization state is switched to another state of said first energization state and said second energization state, in the case that it is determined in said second determination step that said either one state is switched to said another state, said print parameters in accordance with said another state that the one state is switched being calculated in said parameter calculation step.

* * * * *